US005824981A

United States Patent [19]

Suzuki

[11] Patent Number: 5,824,981

[45] Date of Patent: Oct. 20, 1998

[54] WATERPROOF CASE FOR SWITCH

[75] Inventor: Hiroshi Suzuki, Tokyo, Japan

[73] Assignee: Niles Parts Co., Ltd., Japan

[21] Appl. No.: 826,127

[22] Filed: Mar. 27, 1997

[30] Foreign Application Priority Data

Mar. 28, 1996 [JP] Japan ..... 8-099014

[51] Int. Cl.[6] ..... H01H 9/04

[52] U.S. Cl. ..... 200/302.1

[58] Field of Search ..... 200/302.1, 302.2, 200/302.3, 303; 191/26; 312/229; 52/11, 16

[56] References Cited

U.S. PATENT DOCUMENTS

| | | | |
|---|---|---|---|
| 3,276,007 | 9/1966 | White | 200/302.1 X |
| 4,894,498 | 1/1990 | Kagawa et al. | 200/284 |
| 4,913,285 | 4/1990 | Tsutsumi et al. | 200/306 |
| 4,987,278 | 1/1991 | Tsutusmi | 200/303 X |
| 5,508,484 | 4/1996 | Chen | 200/302.1 |
| 5,647,478 | 7/1997 | Hirai | 200/303 |

FOREIGN PATENT DOCUMENTS

| | | | |
|---|---|---|---|
| 3933328 | 6/1990 | Germany | 200/302.1 |
| 2 206 999 | 1/1989 | United Kingdom . | |

*Primary Examiner*—Renee S. Luebke
*Attorney, Agent, or Firm*—Ronald P. Kananen

[57] ABSTRACT

A waterproof case for a switch that prevents the invasion of water drops inside the case of the switch. The waterproof case is comprised of an upper case 1 having holes 1*g* and 1*h* on a side thereof, and a lower case 25 having projected portions 25*a* and 25*b* on a side thereof that fit into the holes 1*g* and 1*h* on the side of the upper case 1. The upper case 1 has ribs 1*i* and 1*j* surrounding the holes 1*g* and 1*h* that guide water drops, which flow from the upper portion to the side of the upper case 1, in the downward direction. Thus, a waterproof case is provided that has ribs surrounding the holes on the side of the upper case so that the ribs 1*i* and 1*j* prevent water drops from entering into the case through the holes 1*g* and 1*h*.

4 Claims, 2 Drawing Sheets

WATERPROOF CASE FOR SWITCH

BACKGROUND OF THE INVENTION

1. Field of the Invention

The present invention relates generally to switches, such as power window switches that automatically open and close windows of an automobile. In particular, the present invention relates to a waterproof case for a switch that prevents the invasion of water drops inside the case of the switch.

DESCRIPTION OF THE RELATED ART

Conventional power window switches that automatically open and close windows of automobiles are mounted on the armrest or the internal wall of a door of the automobile. Many varieties of such power window switches have been suggested, including the one shown in Japanese Laid Open Patent Publication No. Hei 3-37921, for example. These kinds of power window switches are equipped with a switch unit that consists of a switch contact portion and a printed substrate comprised of small switches that have connecting portions. These switch components are enclosed in a case that is comprised of an upper case and a lower case that fits into the upper case.

The upper case has a supported knob that has a hanging or projecting operation lever. By attaching this operation lever of the knob to an operation axle, which is the connecting portion of the switch contact portion, the switch contact portion performs opening and closing of the power windows upon moving the knob in a horizontal direction or a vertical direction.

Conventional power window switches for automatically opening and closing the windows of automobiles are generally structured as mentioned above. The switch contact portion and printed substrate of the conventional power window switch consist of a small switch that is equipped inside a case that is comprised of an upper case and a lower case. Therefore, in order to assemble this case, a projected portion on the side of the lower case is fit into a hole on the side of the upper case.

Therefore, a case comprised and assembled in the above-mentioned manner needs to have a hole on the side of the upper case in order for the projected portion on the side of the lower case to fit therein. Usually, a power window switch that automatically opens and closes the window of an automobile is located on the armrest or internal wall of the door of the automobile. Therefore, when the door of the automobile is open, in particular, when it is raining, there is a problem that water drops stick on the surface of the power window switch.

When water drops stick on the surface of a power window switch in the above-described manner, it is sometimes possible for the water drops to flow down from the upper portion of the upper case, through the hole on the side of the upper case, and thereby enter into the case where the switch unit exists by a capillary tube effect. When the water drop that enters in the case sticks onto the switch contact portion and the printed substrate that comprise the switch unit, a short-circuiting of the circuit or corrosion of the contact point occurs. As a result, there is a problem that the circuit system of the printed substrate becomes defective and the power window switch does not function.

SUMMARY OF THE INVENTION

An object of the present invention is to solve the problems with the conventional switch structures described above.

More specifically, it is an object of the present invention to provide a waterproof case for a power window switch that has a switch contact portion and a printed substrate inside a case that is comprised of an upper case and a lower case.

It is a further object of the present invention to provide a waterproof case for a switch that has a rib that surrounds a hole on the side of the upper case for preventing water drops from entering into the case through the hole, thereby reducing the generation of problems of the switch unit of the power window switch in the case.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

In accordance with the present invention, in order to solve the problems described above, a switch having a waterproof case is provided, comprising: an upper case that has a hole located on a side thereof; a lower case that has a projected portion located on a side thereof for fitting into the hole located on the side of the upper case; a knob supported on the upper case which has a hanging operation lever extending into the upper case for engaging an operation axle of a switch contact portion; the upper case having a rib arranged thereon which surrounds the hole of the upper case and guides liquid drops to flow along the side of the upper case to drain in a downward direction.

The waterproof case is preferably further characterized by the rib, which is formed on the upper case surrounding the hole, having a mountain-shaped upper portion.

In accordance with a further aspect of the present invention, a waterproof case for a switch is provided comprising: an upper case that has a plurality of assembly holes located on a side thereof, the upper case having at least one opening in an upper surface thereof for inserting a switch actuator; and a lower case that has a plurality of assembly projections located on a side thereof, the upper and lower cases being fitted together by placing the lower case within the upper case so that each of the projections engage a respective one of the holes; wherein the upper case has a plurality of ribs formed on the side thereof, a respective one of the ribs surrounding each of the assembly holes and having an apex above the assembly hole for guiding liquid along the side of the upper case to drain in a downward direction away from the assembly holes.

The ribs formed on the upper case preferably comprise first and second vertical portions and an inverted V-shaped portion connecting the first and second vertical portions.

The waterproof case of the switch of the present invention is extremely suitable for a power window switch located on the arm rest or internal wall of a door of an automobile that automatically opens and closes the window of an automobile, because the waterproof case effectively prevents water from entering into the case of the power window switch.

The waterproof case of the switch in the present invention is comprised of an upper case and a lower case that together enclose a switch contact portion and a printed substrate of the power window switch inside the case. In order to assemble this case, a projected portion on the side of the lower case is fit into a hole on the side of the upper case. Therefore, because there is a possibility that water drops will enter into the case from the hole on the side of the upper case by a capillary tube effect, a rib is mounted on the upper case that surrounds the area around the hole on the side of the upper case. Thus, water drops that flow from the upper portion of the upper case to the side are led in the downward direction and drained.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENT

Figure 1:
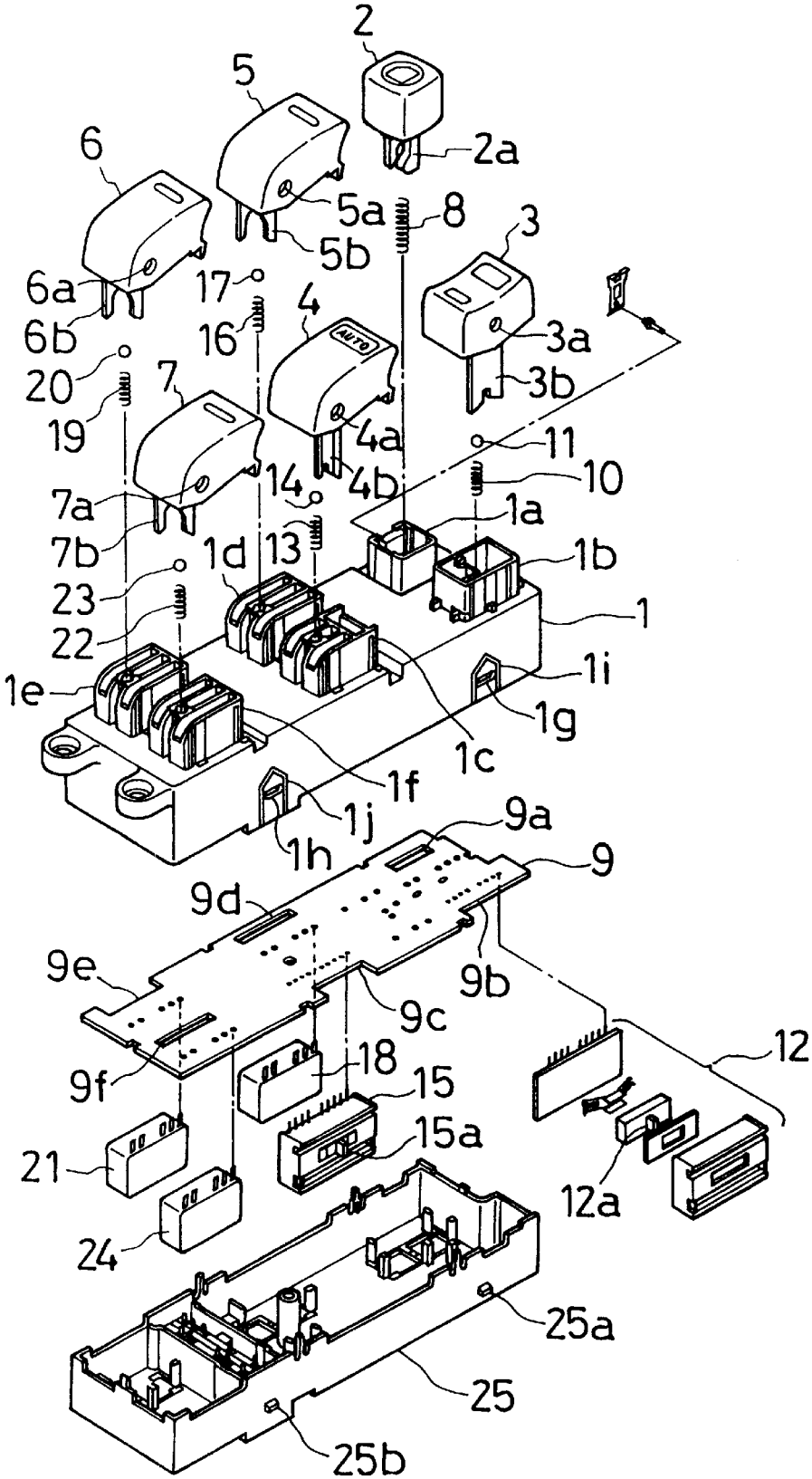
FIG. 1 is an exploded perspective view of a power window switch having a waterproof case according to a preferred embodiment of the present invention.

A preferred embodiment of a switch and waterproof case according to the present invention will now be described in detail with reference to FIGS. 1 to 3 of the drawings.

The waterproof case of the present invention is designed for a power window switch of an automobile and is located in the armrest or the internal wall of a door of the automobile. The switch case includes an upper case 1 that has switch actuators in the form of knobs 2, 3, 4, 5, 6 and 7 mounted on an upper surface thereof.

The knob 2 is an operational part of a push-lock switch that locks a window. It is assembled onto the upper case 1 by hooking a hook (not shown) on a projection (not shown) inside a cylinder 1*a* of the upper case 1 via a spring 8, so that the knob 2 moves freely in the upward and downward directions. The knob 2 has an operation lever 2*a* that passes through the cylinder 1*a*. The operation lever 2*a*, which moves upward and downward, passes through the cylinder 1*a* and through a hole 9*a* of a printed substrate 9 and fits into the operation axle (not shown) of the switch contact portion (not shown).

The knob 3 is an operational part of a seesaw switch that locks a door. The knob 3 is assembled onto the upper case 1 by fitting a hook (not shown) inside a hole 3*a* into a supporting axle (not shown) inside a cylinder 1*b* of the upper case 1, so that the knob 3 moves freely. Inside the knob 3, there is a control gutter (not shown) into which a steel ball 11, which is attached to a spring 10, is pressed. This control gutter allows the knob 3 to automatically go back to the off position. The knob 3 contains a Y-shaped operation lever 3*b*. The lower edge of the operation lever 3*b* passes through the cylinder 1*b* and a notch 9*b* of the printed substrate 9 and is fitted into an operation axle 12*a* of a switch contact portion 12.

The knob 4 is an operational part of a two-step seesaw switch that opens and closes the window for the driver seat. The knob 4 is assembled onto the upper case 1 by fitting a hook (not shown) inside a hole 4*a* to a supporting axle (not shown) inside a cylinder 1*c* of the upper case 1, so that the knob 4 moves freely. The knob 4 moves a window up and down during the operation time of the first-step operation. With the second-step operation, the knob 4 automatically moves the window up and down. Inside the knob 4, there is a control gutter (not shown) into which a steel ball 14, which is attached to a spring 13, is pressed. This control gutter allows the knob 4 to automatically go back to the off position. The knob 4 contains a Y-shaped operation lever 4*b*. The lower edge of the operation lever 4*b* passes through the cylinder 1*c* and a notch 9*c* of the printed substrate 9 and fits into an operation axle 15*a* of the switch contact portion 15.

The knob 5 is an operational part of an automatic-return seesaw switch that opens and closes the window for the passenger seat. The knob 5 is assembled onto the upper case 1 by fitting a hook (not shown) inside a hole 5*a* to the supporting axle (not shown) inside a cylinder 1*d* of the upper case 1, so that the knob 5 moves freely. Inside the knob 5, there is a control gutter (not shown) into which a steel ball 17, which is attached to a spring 16, is pressed. This control gutter allows the knob 5 to automatically go back to the off position. The knob 5 contains a Y-shaped operation lever 5*b*. The lower edge of the operation lever 5*b* passes through the cylinder 1*d* and a through hole 9*d* of the printed substrate 9 and fits into the operation axle (not shown) of a switch contact portion 18.

The knob 6 is an operational part of an automatic-return seesaw switch that opens and closes the window for the right rear passenger seat. The knob 6 is assembled onto the upper case 1 by fitting a hook (not shown) inside a hole 6*a* to the supporting axle (not shown) inside a cylinder 1*e* of the upper case 1, so that the knob 6 moves freely. Inside the knob 6, there is a control gutter (not shown) into which a steel ball 20, which is attached to a spring 19, is pressed. This control gutter allows the knob 6 to automatically go back to the off position. The knob 6 contains a Y-shaped operation lever 6*b*. The lower edge of the Y-shaped operation lever 6*b* passes through the cylinder 1*e* and a notch 9*e* of the printed substrate 9 and fits into the operation axle (not shown) of a switch contact portion 21.

The knob 7 is an operational part of an automatic-return seesaw switch that opens and closes the window for the left rear passenger seat. The knob 7 is assembled onto the upper case 1 by fitting a hook (not shown) inside a hole 7*a* to the supporting axle (not shown) inside a cylinder if of the upper case 1, so that the knob 7 moves freely. Inside the knob 7, there is a control gutter (not shown) into which a steel ball 23, which is attached to a spring 22, is pressed. This control gutter allows the knob 7 to automatically go back to the off position. The knob 7 contains a Y-shaped operation lever 7*b*. The lower edge of the operation lever 7*b* passes through the cylinder if and a through hole 9*f* of the printed substrate 9 and fits into the operation axle (not shown) of a switch contact portion 24.

A plurality of assembly holes 1*g* and 1*h* are formed on the side of the upper case 1. A corresponding plurality of assembly projections 25*a* and 25*b* are formed on the side of lower case 25. The case is assembled by fitting the projected portions 25*a* and 25*b* of the lower case 25 into the holes 1*g* and 1*h* of the upper case 1, respectively. The upper case 1 and lower case 25 are both made by a molding process for plastic. Therefore, the upper case 1 and the lower case 25 are firmly fitted together with pressure resistance.

Ribs 1*i* and 1*j* are formed on the side of the upper case 1 surrounding the holes 1*g* and 1*h* at a desired height (for example, approximately 0.3 mm). As shown in FIGS. 1 to 3, the ribs 1*i* and 1*j* have an apex above the assembly holes 1*g*, 1*h* for guiding liquid along the side of the upper case to drain in a downward direction away from the assembly holes 1*g*, 1*h*. More specifically, each of the ribs 1*i*, 1*j* has first and second vertical portions on either side of the respective assembly holes 1*h*, 1*g* and an inverted V-shaped portion connecting the first and second vertical portions.

As mentioned above, a power window switch that automatically opens and closes the window of an automobile is normally located on the armrest or internal wall of a door of the automobile. Therefore, when the door of the automobile is opened during adverse weather conditions, such as during a rain storm or the like, there is a problem that water drops impact on the surface of the power window switch. Such a problem might also arise, for example, when a drink is spilled over the power window switch.

The present invention is characterized by a structure wherein the ribs 1*i* and 1*j* surround the holes 1*g* and 1*h* on the side of the upper case 1. Therefore, when water or liquid drops contact the surface of the power window switch, as described above, the liquid flows from the upper portion of the upper case 1 over the side of the upper case 1 in an orderly fashion. As shown by the arrows in FIG. 3, the liquid is guided to flow along the circumference of the ribs 1*i* and 1*j* in a generally downward direction. Finally, the liquid becomes a dripping liquid drop 26 and drains in the downward direction from the upper case 1.

Therefore, with the power window switch of the present invention, by having the ribs 1*i* and 1*j* surrounding the holes 1*g* and 1*h* on the side of the upper case 1, it is possible to prevent, with certainty, water drops from entering into the case 1 through the holes 1*g* and 1*h* of the upper case 1. Therefore, it is possible to protect the unit of the power window switch that exists within the upper case 1 and the lower case 25 from water drops, so that it is possible to reduce the generation of faults of the switch unit.

Figure 2:
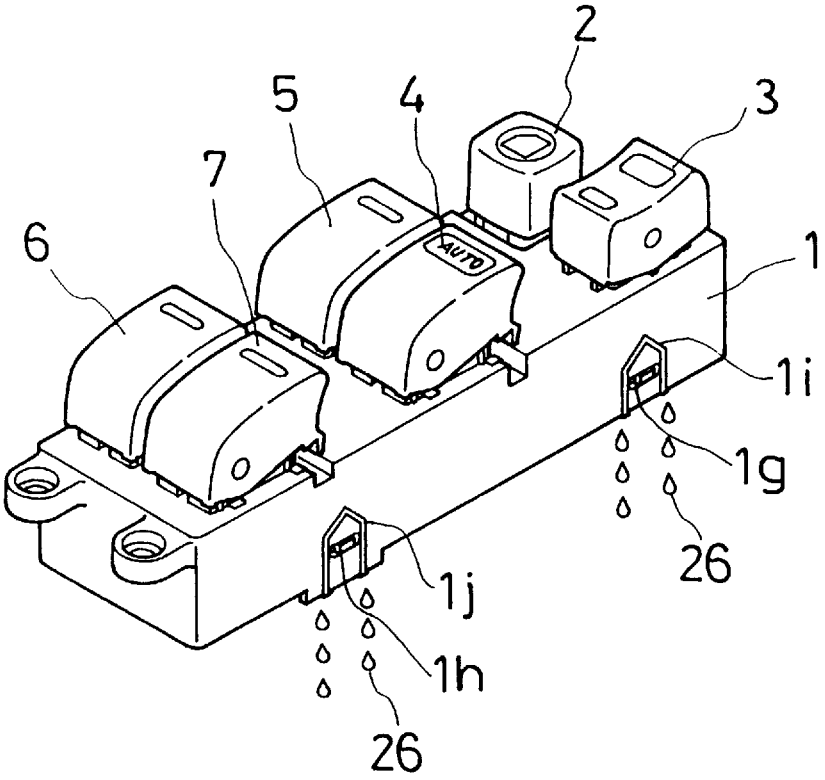
FIG. 2 is an assembled perspective view that shows the upper case portion of the power window switch shown in FIG. 1 according to the present invention.
Figure 3:
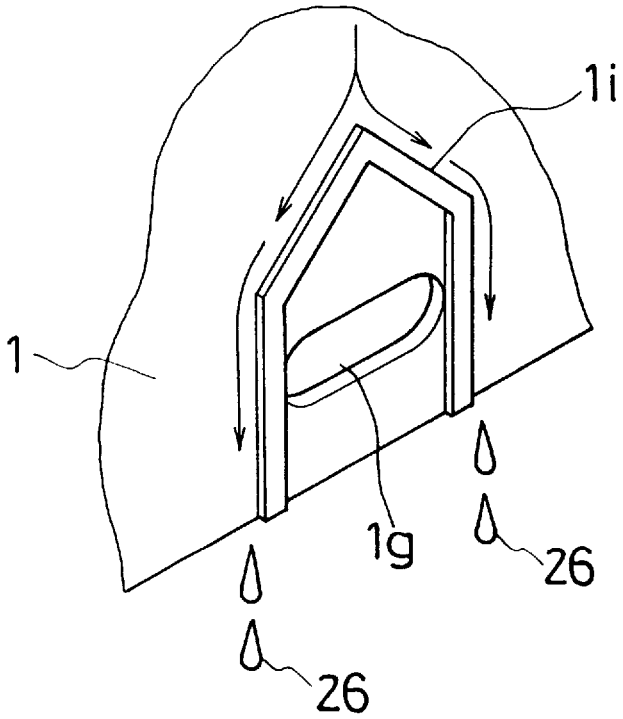
FIG. 3 is an enlarged perspective view of a rib feature formed on the upper case shown in FIG. 2 for guiding liquid flow over the upper case.

As shown in FIGS. 1 to 3, the shape of the ribs 1*i* and 1*j* surrounding the holes 1*g* and 1*h* on the side of the upper case 1 is a mountain-shape on the upper portion, so that water drops that flow from the upper portion to the side of upper case 1 can, with certainty, be smoothly drained in the downward direction. However, it will also be appreciated by those of skill in the art that the shape of the ribs 1*i* and 1*j* can be other than a mountain-shape.

The waterproof case for a switch, as described above, produces a superior effect for a switch that has a switch unit stored in a case that is comprised of an upper case and a lower case that has a projected portion on the side in order to fit into a hole located on the side of the upper case, by having a rib that guides the flow of water drops along the side of the upper portion of the upper case in the downward direction and drains the water drops, thereby making it possible to prevent water drops from entering into the case through the holes of the upper case. As a result, the generation of faults of the switch unit due to water drops can be significantly reduced.

In the preferred embodiment, the waterproof case of the present invention has ribs surrounding the holes on the side of the upper case which have a mountain shape, so that water drops that flow from the upper portion to the side of the upper case flow along the circumference of the mountain-shaped ribs, and are smoothly guided and drained in the downward direction with certainty.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

What is claimed is:

1. A switch having a waterproof case, comprising:

an upper case that has a hole located on a vertically inclined side thereof;

a lower case that has a projected portion located on a vertically inclined side thereof for fitting into said hole located on the side of the upper case; and a knob supported on said upper case which has a hanging operation lever extending into said upper case for engaging an operation axle of a switch contact portion;

wherein said upper case has a rib arranged thereon which surrounds, and extends below the hole of said upper case and guides liquid to flow along the side of the upper case to drain in a downward direction, and drip from a bottom edge of said vertically inclined side of said upper case.

2. The switch having a waterproof case according to claim 1, wherein an upper portion of the rib that surrounds the hole on the upper case has a mountain shape.

3. A waterproof case for a switch, comprising:

an upper case that has a plurality of assembly holes located on a vertically extending side thereof, said upper case having at least one opening in an upper surface thereof for inserting a switch actuator; and a lower case that has a plurality of assembly projections located on a vertically extending side thereof, said upper and lower cases being fitted together by placing said lower case within said upper case so that each of said projections engage a respective one of said holes;

wherein said upper case has a plurality of ribs formed on the side thereof, a respective one of said ribs surrounding and extending below each of said assembly holes and having an apex above the assembly hole for guiding liquid brought from outside of said upper case along the side of the upper case to drain in a downward direction below and away from said assembly holes.

4. The switch having a waterproof case according to claim 3, wherein each of said ribs has first and second vertical portions and an inverted V-shaped portion connecting said first and second vertical portions.

* * * * *